US008250699B2

(12) United States Patent
Hu

(10) Patent No.: US 8,250,699 B2
(45) Date of Patent: Aug. 28, 2012

(54) MOP HOLDER

(75) Inventor: GuoMing Hu, Taizhou (CN)

(73) Assignee: Yin Sham MFG Brushes Co., Ltd., Yuanqiao Town, Huangyan Pise., Taizho Zhejiang (CN)

( * ) Notice: Subject to any disclaimer, the term of this patent is extended or adjusted under 35 U.S.C. 154(b) by 511 days.

(21) Appl. No.: 12/458,297

(22) Filed: Jul. 8, 2009

(65) Prior Publication Data

US 2010/0175211 A1 Jul. 15, 2010

(30) Foreign Application Priority Data

Jan. 10, 2009 (CN) ..... 2009 2 0003173 U

(51) Int. Cl.
*A47L 13/20* (2006.01)

(52) U.S. Cl. ..... 15/150

(58) Field of Classification Search ..... 15/147.1, 15/150, 151, 152, 153
See application file for complete search history.

(56) References Cited

U.S. PATENT DOCUMENTS

| | | | | |
|---|---|---|---|---|
| 4,287,632 | A * | 9/1981 | Hammond | 15/150 |
| 4,553,282 | A * | 11/1985 | Batchelor | 15/150 |
| 5,724,696 | A * | 3/1998 | Di Giammarino | 15/150 |
| 5,918,340 | A * | 7/1999 | Young | 15/115 |
| 6,098,235 | A * | 8/2000 | Tomm et al. | 15/150 |
| 6,637,065 | B2 * | 10/2003 | Biggs | 15/150 |
| 7,039,969 | B2 * | 5/2006 | Zorzo | 15/147.1 |
| 7,246,399 | B2 * | 7/2007 | Petner | 15/150 |
| 7,854,035 | B2 * | 12/2010 | Gullicks et al. | 15/147.1 |

* cited by examiner

*Primary Examiner* — Mark Spisich
*Assistant Examiner* — Michael Jennings

(57) ABSTRACT

A mop holder which provides fast changing of mop cloth and ease of use comprises: a supporter (1) which consists of a first and second support (15, 16), each is positioned on a side of a handle holder (5). One end of the bottom of the first support (15) is connected pivotally with a limb (2); and said second support (16) contains a space (14) where a trigger (6) is disposed therein. A lever (7) is set on an edge of the space (14) which is parallel with the handle holder (5); and a shoulder (8) is disposed on the bottom of said lever (7). A gap (9) is spaced between the lever (7) and the bottom edge of the space (14). A free end of the limb (2) includes a locating slot (10) which corresponds with said shoulder (8); and an angled surface (11) is disposed on the upper edge of the slot (10) for guiding the shoulder (8) into the slot (10).

2 Claims, 6 Drawing Sheets

MOP HOLDER

FIELD OF THE INVENTION

The present invention relates to a mop holder.

BACKGROUND OF THE INVENTION

A Mop is a tool commonly used for house cleaning, and a mop holder is a device for fixing the mop cloth. A conventional mop holder usually comprises a screw, when changing a mop cloth, said screw is released and new mop cloth is placed on the holder, afterward, the screw is tighten to hold the mop cloth again. This technique is relatively complex and since the mop contacts with water constantly, screw may oxidize easily, increasing difficulty to release the screw.

SUMMARY OF THE INVENTION

A mop holder that provides fast change of mop cloth comprises a supporter (1) having pluralities of teeth (4) disposed on a bottom, and a handle holder (5) set on a middle thereof; and A limb (2) connected with one end of the bottom of said supporter (1); and a pivot (3) is disposed where the limb (2) connects with the supporter (1) for providing a pivotal connection.

Said mop holder is characterized in that: said supporter (1) comprises a first support (15) which is positioned on a left side of the handle holder (5), and a second support (16) positioned on a right side thereof. A bottom of the first support (15) is pivotally connected with the limb (2). Said second support (16) includes a space (14) and a trigger (6), made of flexible material, is disposed in a middle of said space (14); a lever (7) is disposed on an edge of the space (14) where is parallel with the handle holder (5), a shoulder (8) is disposed on a bottom of said lever (7) and a gap (9) is kept between said lever (7) and bottom edge of said space (14).

Further, a free end of said limb (2) includes a locating slot (10) which correspond said shoulder (8) and an angled surface (11) is set on an upper edge of the slot (10) for guiding the shoulder (8) into the slot (10).

An end of said trigger (6) where is close to the lever (7) is fixed securely with the lever (7); and another end of the trigger (6) where is close to the handle holder (5) is fixed securely the holder (5).

Moreover, an end of the lever (7) where connects with the supporter (1) includes a groove (12) for providing the lever (7) with flexibility.

Another type of mop holder, which is similar to previous embodiment is characterized in that an end of said trigger (6) where is close to the lever (7) is fixed firmly with the lever (7); another end of the trigger (6) where is close to the handle holder (5) is spaced with an interval (13) and a distance (H2) of said interval (13) is smaller than a distance (H1) of the gap (9). Said trigger (6) is made of rigid material and the lever (7) is made of flexible material.

DETAIL DESCRIPTION OF PREFERRED EMBODIMENTS

Description of the present invention is described in detail according to the appended drawings hereinafter.

First Embodiment

Figure 1:
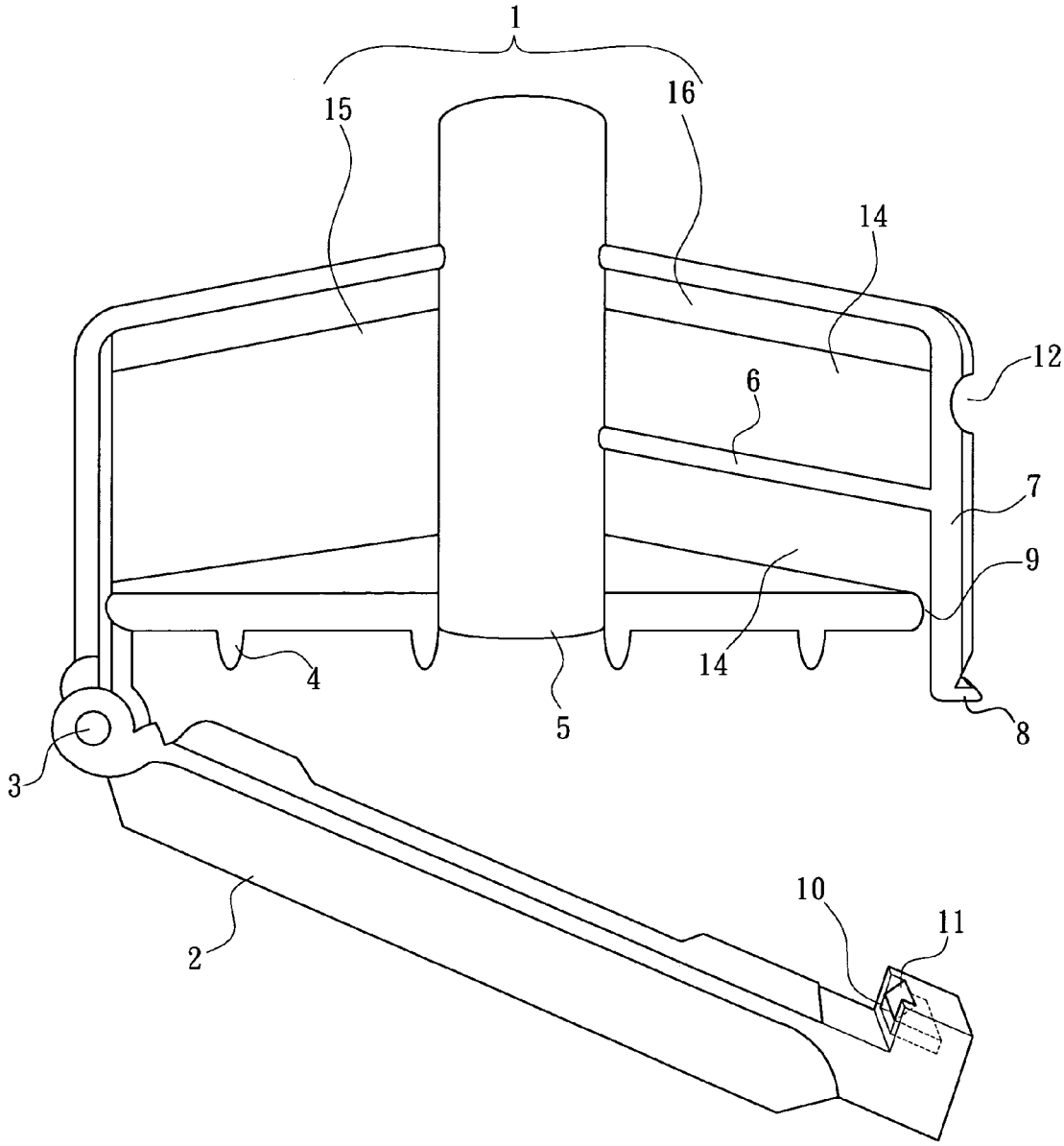
FIG. 1 is a schematic view of the first embodiment.

As shown in FIG. 1, A mop holder that provides fast change of mop cloth comprises a supporter (1) having pluralities of teeth (4) disposed on a bottom, and a handle holder (5) set on a middle thereof; and A limb (2) connected with one end of the bottom of said supporter (1); and a pivot (3) is disposed where the limb (2) joints with the supporter (1) for providing a pivotal connection.

Said mop holder is characterized in that: said supporter (1) comprises a first support (15) which is positioned on a left side of the handle holder (5), and a second support (16) positioned on a right side thereof. A bottom of the first support (15) is pivotally jointed with the limb (2). Said second support (16) includes a space (14) and a trigger (6), made of flexible material, is disposed in a middle of said space (14); a lever (7) is disposed on an edge of the space (14) where is parallel with the handle holder (5), a shoulder (8) is disposed on a bottom of said lever (7) and a gap (9) is kept between said lever (7) and bottom edge of said space (14).

Further, a free end of said limb (2) includes a locating slot (10) which correspond said shoulder (8) and an angled surface (11) is set on an upper edge of the slot (10) for guiding the shoulder (8) into the slot (10).

Figure 3:
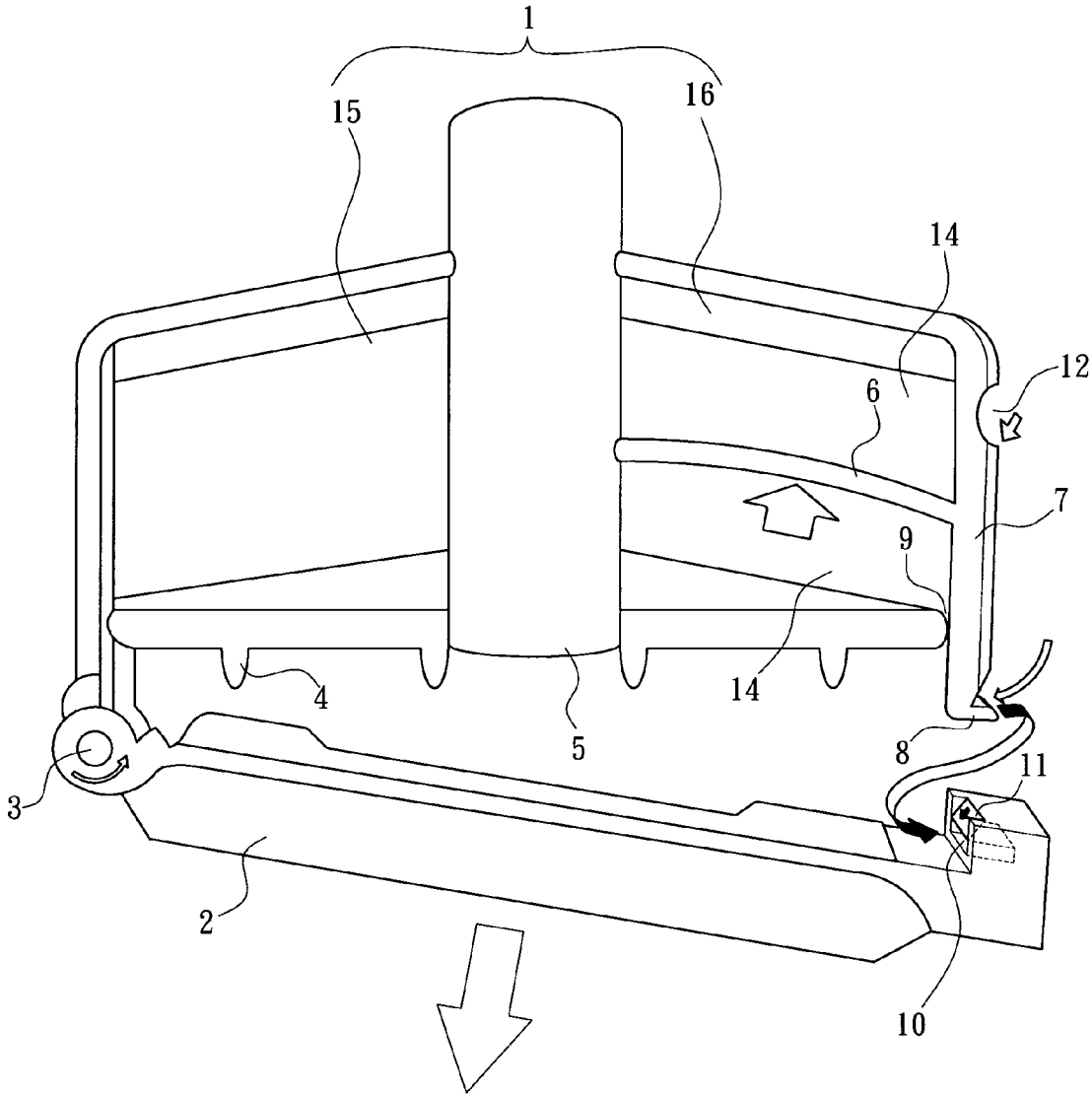
FIG. 3 is a schematic view of the first embodiment, illustrating the disengagement of limb.
Figure 4:
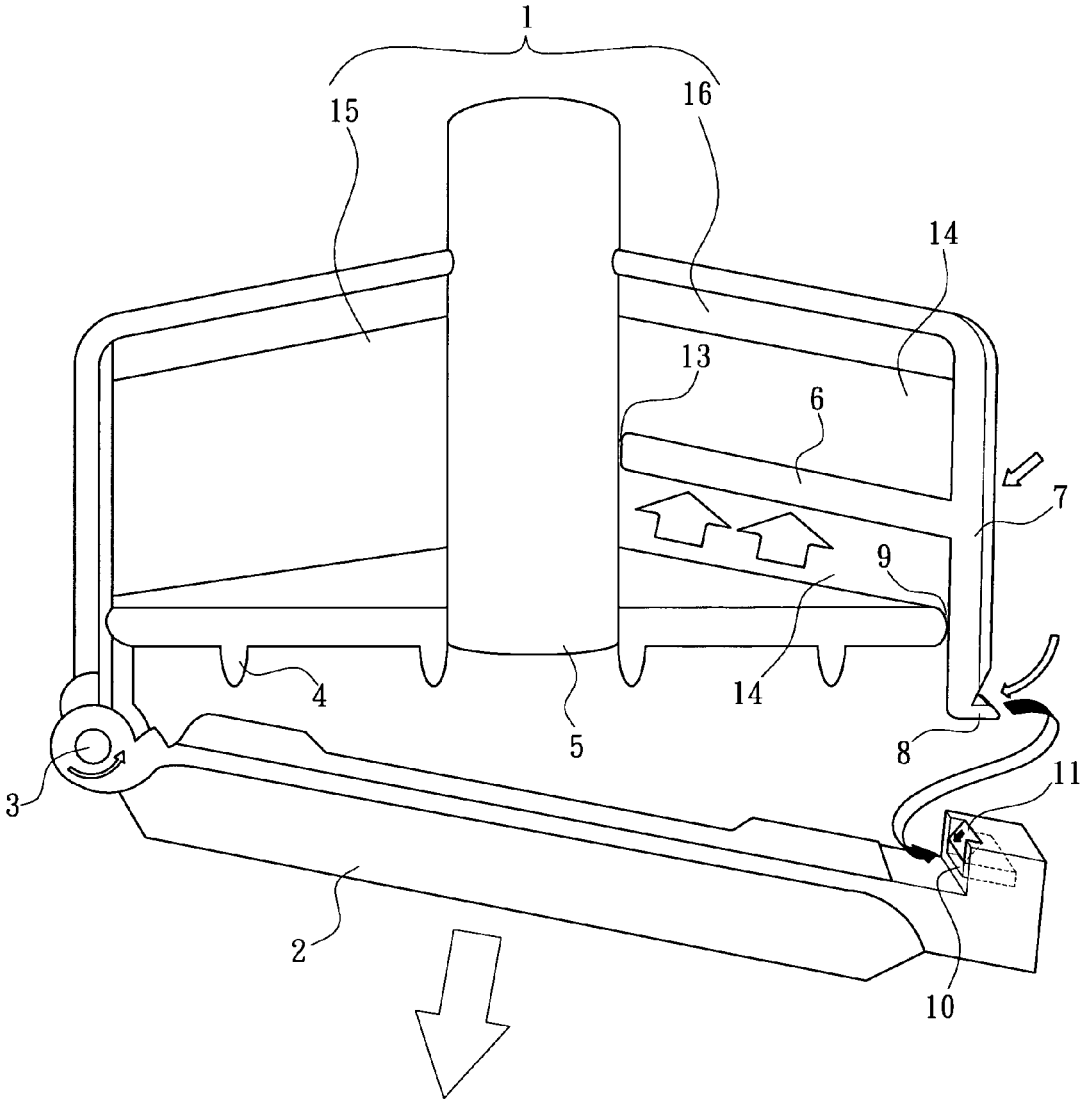
FIG. 4 is a schematic view of the second embodiment, illustrating the disengagement of limb.
Figure 5:
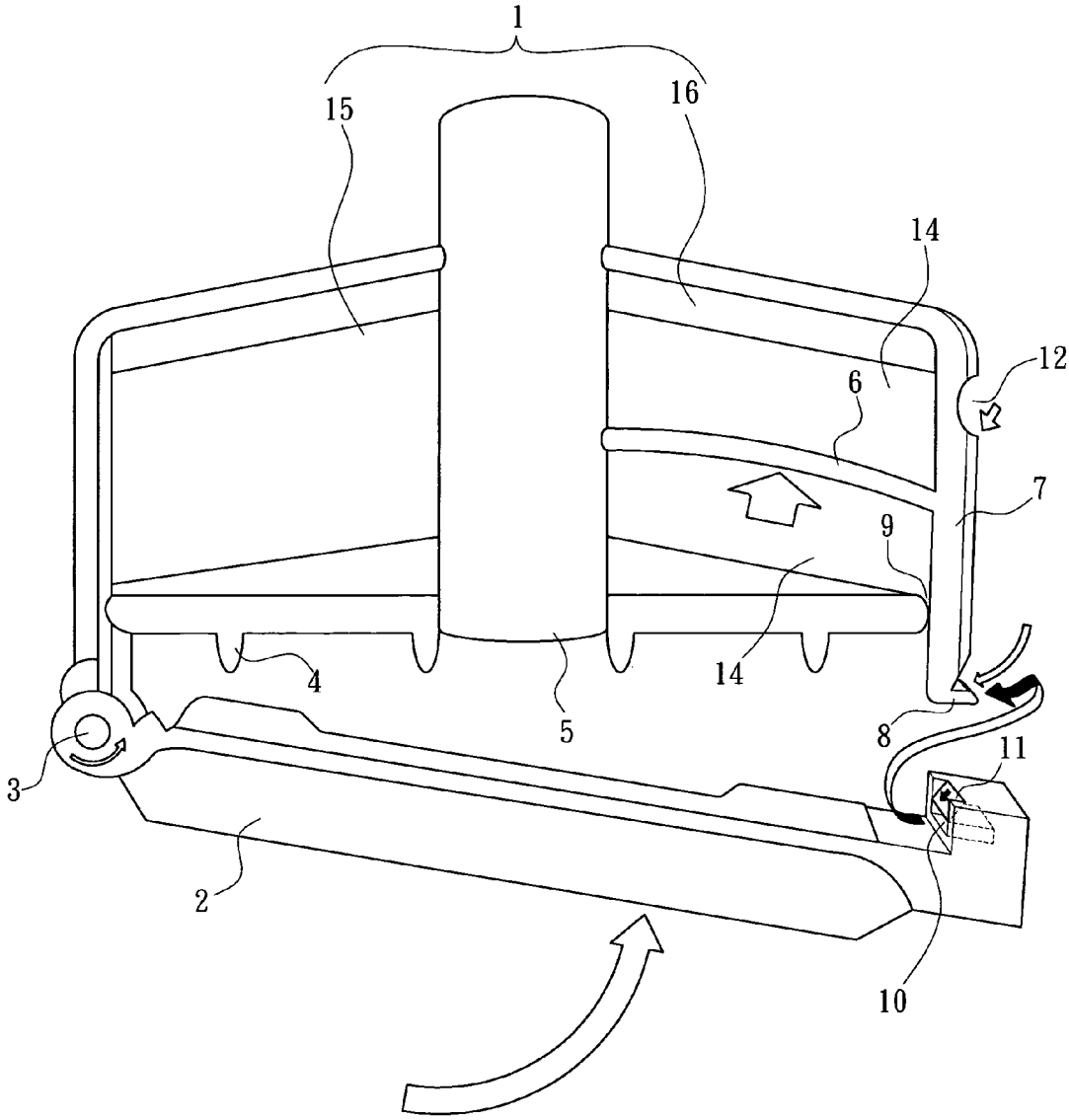
FIG. 5 is a schematic view of the first embodiment, illustrating the engagement of limb.
Figure 6:
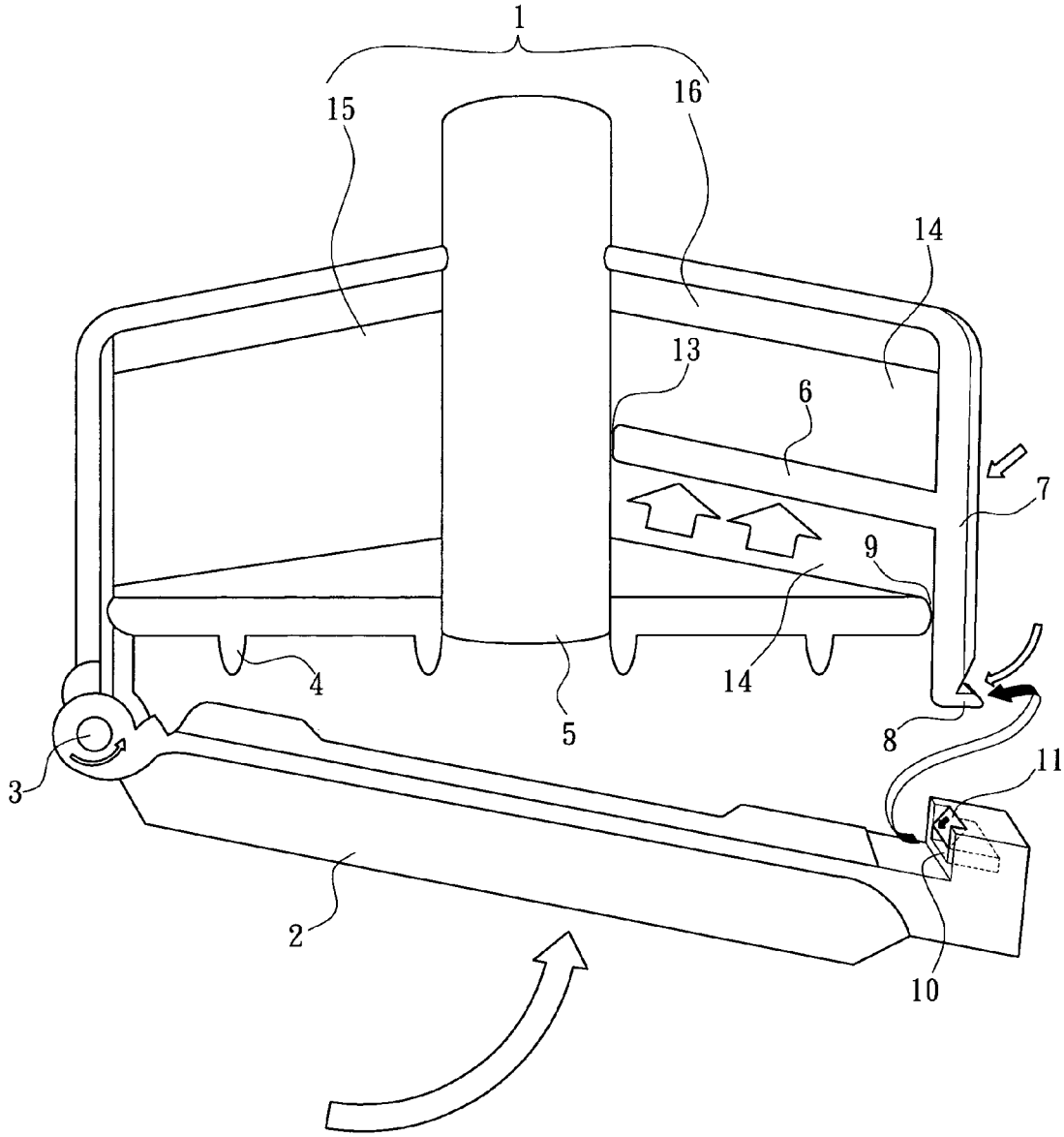
FIG. 6 is a schematic view of the second embodiment, illustrating the engagement of limb.

Referring to FIG. 3, by having said mechanism, an user can press the trigger (6) to cause the reaction of the lever (7), forcing the shoulder (8) to engage/disengage with the locating slot (10) and allowing the limb (2) be moved pivotally to achieve efficient change of the mop cloth.

An end of said trigger (6) where is close to the lever (7) is fixed securely with the lever (7); another end of the trigger (6) where is close to the handle holder (5) is fixed firmly with the holder (5); and an end of the lever (7) where connects to the supporter (1), includes a groove (12) for providing the lever (7) with flexibility.

Since both ends of said trigger (6) are fixed with the lever (7) and handle holder (5) respectively, when trigger (6) is pressed and deformed, the lever (7) which includes a groove (12) will be bent toward said trigger (6), forcing the shoulder (8) to disengage with the slot (10).

Second Embodiment

Figure 2:
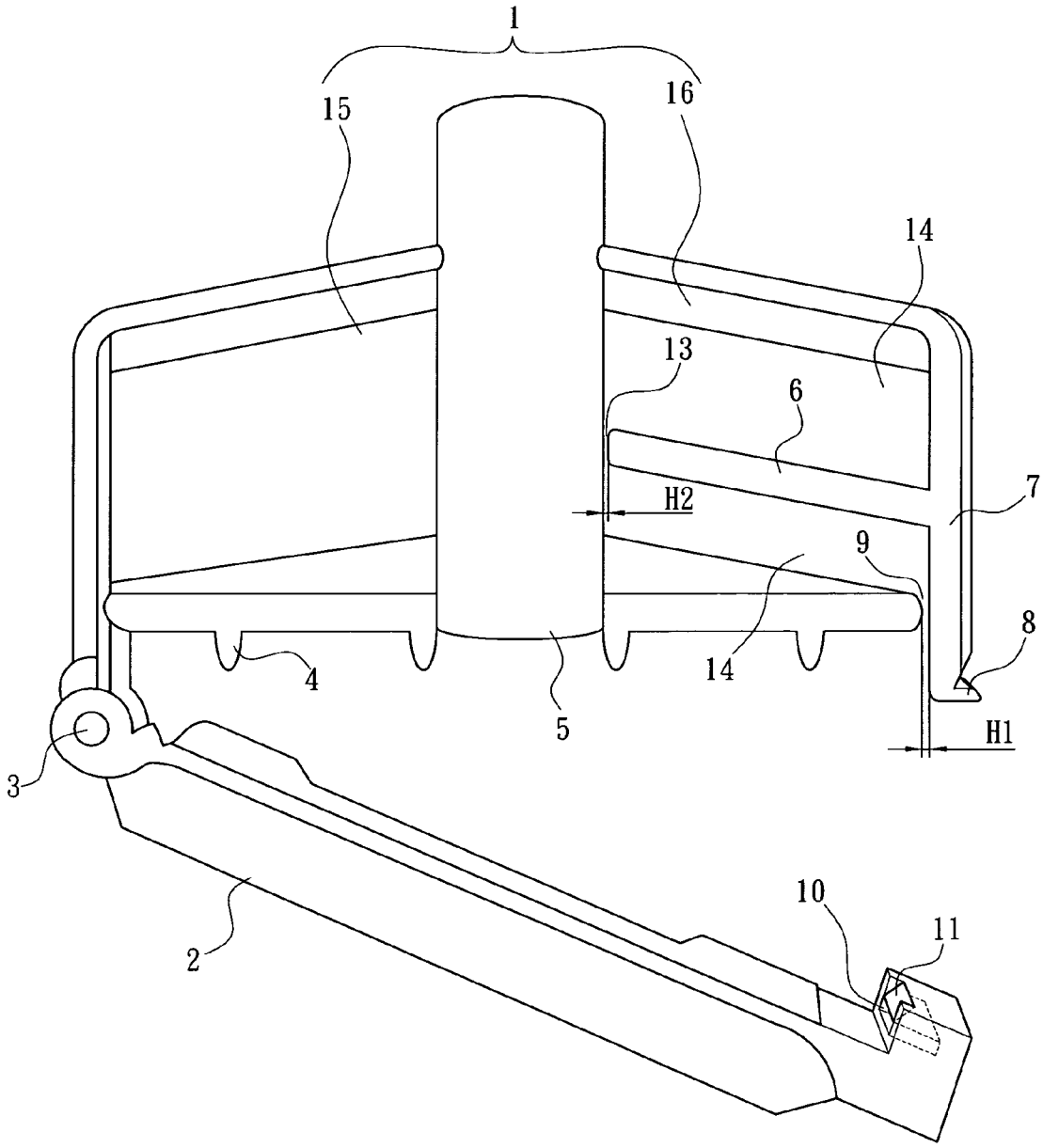
FIG. 2 is a schematic view of the second embodiment.

The second embodiment consists of most elements of the first embodiment. As illustrating in FIG. 2, the second embodiment is characterized in that having an end of said trigger (6) fixed firmly with the lever (7); another end of the trigger (6) where is close to the handle holder (5) is spaced with an interval (13) and a distance (H2) of said interval (13) is shorter than a distance (H1) of the gap (9). Said trigger (6) is made of rigid material and the lever (7) is made of flexible material.

Since the lever (7) doesn't comprise the groove (12) as disclosed in the first embodiment, the lever (7) is given stronger strength to resist impact, improving the fixture of shoulder (8) and slot (10).

The interval (13) serves for two objectives, first, to provide an adequate space for trigger (6) to be bent and causing deformation of lever (7); second, to serve as a safety space. Since the interval (13) is shorter than the gap (9), a distance between lever (7) and bottom edge of the space (14), thus, the trigger (6) will adjoin the handle holder (5) before the lever (7) contacting with the space (14) and preventing disengagement of shoulder (8) with slot (10).

The trigger (6) of the second embodiment is made of rigid material, a harden material generates bigger force to pull the lever (7), causing bigger deformation; therefore, the lever (7) should be made of flexible material to achieve the mechanism.

By referring to FIGS. 3-6, the complete function of changing mop cloth in accordance with both first and second embodiments can be described. For replacing mop cloth with the first embodiment, a user first applies a force to the trigger (6) by palm or finger, pulling the trigger (6) upwardly. The lever (7) which is fixed with the trigger (6), will be pulled and bent toward the trigger (6), causing the shoulder (8) to release from the locating slot (10). Afterward, the limb (2) is allowed to pivot and mop cloth can be changed.

To secure the mop cloth, a force is again applied to the trigger (6) and when lever (7) is bent, it pivots the limb (2). An angled surface (11) disposed on an upper edge of the locating slot (10) will direct the shoulder (8) sliding into the slot (10) and the mop cloth is held firmly.

The second embodiment functions as same as the first embodiment. However, by applying a force to the trigger (6), the trigger (6) doesn't bend but to be pulled upwardly, generating a force to deform the lever (7), causing the shoulder (8) to be released from the locating slot (10) and replacing the mop cloth.

For holding mop cloth on the mop holder, another force is applied to the trigger (6), forcing the shoulder (8) toward the trigger (6); and when limb (2) pivots back to the securing position, the angled surface (11) directing the shoulder to slide into the locating slot (10) and fixes the mop cloth onto the mop holder.

What is disclosed above are only the preferred embodiments of the present invention and it is therefore not intended that the present invention be limited to particular embodiments disclosed. It will be understood by those skilled in the art that various equivalent changes may be made depending on specification and drawings of present invention without departing from the scope of the present invention.

What is claimed is:

1. A mop holder consists essentially of;

a supporter (1) having pluralities of teeth (4) disposed on a bottom, and a handle holder (5) set on a midst thereof; and A limb (2) is jointed with one end of the bottom of said supporter (1) by a pivot (3) for providing a pivotal connection;

Said mop holder is characterized in that said supporter (1) comprises a first support (15) which is positioned on a left side of the handle holder (5), and a second support (16) positioned on a right side thereof; a bottom of the first support (15) is pivotally connected with the limb (2); said second support (16) includes a space (14) and a trigger (6) is disposed in a midst of said space (14); a lever (7) is disposed on an edge of the space (14) which is parallel with the handle holder (5), a shoulder (8) is disposed on a bottom of said lever (7); a gap (9) is kept between said lever (7) and bottom edge of said space (14);

A free end of said limb (2) includes a locating slot (10) which corresponds with said shoulder (8); and an angled surface (11) is set on an upper edge of the slot (10) for guiding the shoulder (8) into the slot (10);

wherein an end of said trigger (6) where close to the lever (7) is fixed securely therewith and another end where is close to the handle holder (5) is spaced with an interval (13);

wherein a distance (H2) of said interval (13) is shorter than a distance (H1) of the gap (9);

wherein said trigger (6) is made of rigid material.

2. A mop holder of claim 1, wherein said lever (7) is made of flexible material.

* * * * *